United States Patent [19]

Hirobumi et al.

[11] Patent Number: 4,516,944

[45] Date of Patent: May 14, 1985

[54] EXPANSION TYPE LIFE-SAVING RAFT

[75] Inventors: Saito Hirobumi; Ito Kiyoshi; Higuchi Kaichi; Yamamoto Masao, all of Sagamihara, Japan

[73] Assignee: Mitsubishi Denki Kabushiki Kaisha, Tokyo, Japan

[21] Appl. No.: 531,832

[22] PCT Filed: Dec. 2, 1982

[86] PCT No.: PCT/JP82/00459

§ 371 Date: Aug. 3, 1983

§ 102(e) Date: Aug. 3, 1983

[87] PCT Pub. No.: WO83/01933

PCT Pub. Date: Jun. 9, 1983

[30] Foreign Application Priority Data

Dec. 3, 1981 [JP] Japan ..... 56-195072

[51] Int. Cl.[3] ..... B63C 9/04

[52] U.S. Cl. ..... 441/40; 114/345

[58] Field of Search ..... 441/35–42; 114/345, 348, 349, 367

[56] References Cited

U.S. PATENT DOCUMENTS 4,280,239 7/1981 Brow ..... 441/42

FOREIGN PATENT DOCUMENTS 226884 11/1958 Australia ..... 441/38

1101585 1/1968 United Kingdom ..... 441/38

*Primary Examiner*—Galen L. Barefoot

*Assistant Examiner*—Jesûs D. Sotelo

*Attorney, Agent, or Firm*—Oblon, Fisher, Spivak, McClelland & Maier

[57] ABSTRACT

An expansion type life-saving raft, in which the life saving raft is folded with the awning thereof being placed inside when it is housed in a container, after which fitting members are fixedly provided at opposite positions on the outer peripheral part of the annular gas chamber which is folded in mutual confrontation, and subsequently providing a fastening mechanism, which is capable of being ruptured, etc. by force of expansion of the annular gas chamber, between the fitting members, thereby making it possible to expand the raft with the awning thereof being positioned upward without failure so as to enable individuals to promptly be evacuated into the life-saving raft.

11 Claims, 15 Drawing Figures

FIGURE 1 *PRIOR ART*
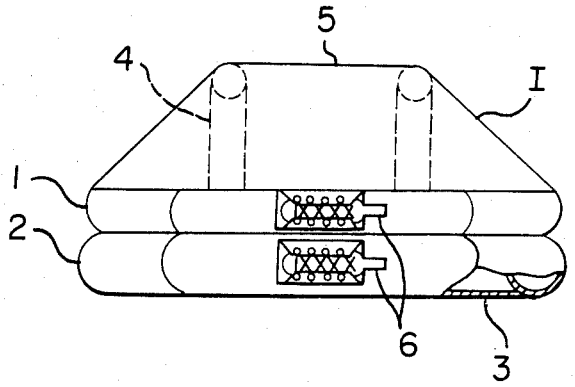
FIGURE 2 *PRIOR ART*
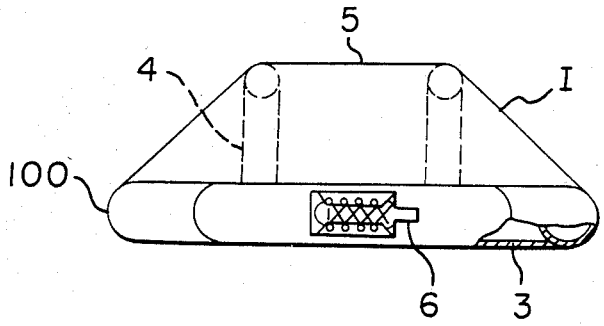

7
9
110
10
8

7
I 51
5
I
1
2
20

FIGURE 6 *PRIOR ART*
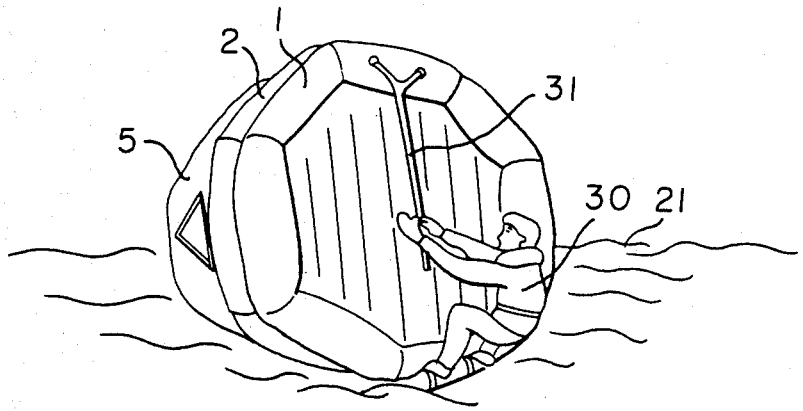
FIGURE 7
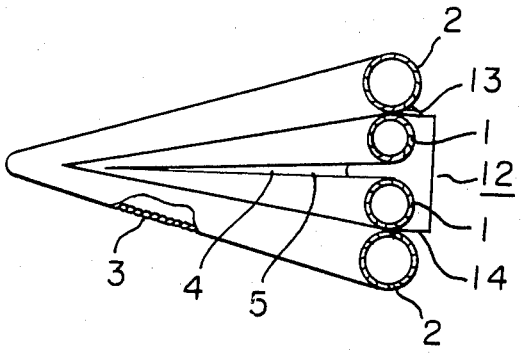

EXPANSION TYPE LIFE-SAVING RAFT

FIELD OF TECHNOLOGY

This invention relates to an expansion-type life-saving raft to be used at the time of disaster, etc. of ships, boats, etc. More particularly, it is concerned with an expansion type life-saving raft provided with a device for regularly expanding it with the awning portion thereof being upwardly directed at the time when it is dropped from the ship to be expanded.

TECHNICAL BACKGROUND

Conventionally, there have been various types of the expansion type life-saving rafts. In this connection, as one example an outline of the expansion type life-saving raft with the awning as shown in FIG. 1 will be explained. In the drawing, 1 refers to an upper annular gas chamber (hereinafter called "an upper gas chamber"), 2 refers to a lower annular gas chamber (hereinafter called "a lower gas chamber"), both upper gas chamber 1 and lower gas chamber 2 being rigidly fastened. Number 3 refers to a floor gas chamber fixedly secured to the bottom surface of the lower gas chamber 2, crews getting in on this floor gas chamber 3. Number 4 designates stanchion gas chambers provided on the top part of the upper gas chamber 1, and 5 denotes an awning which is supported by the stanchion gas chambers 4 to form a roof part and has an entrance for the crews. Incidentally, 6 denotes pressurized bottles to fill gas into each of the above-mentioned gas chambers 1, 2, 3 and 4. They are, in general, fitted separately on the upper gas chamber 1 and the lower gas chamber 2. The expansion type life-saving raft I with an awning is formed with such a construction, and is usually folded and housed in and exclusive container to be mentioned later together with other equipment of the ship.

Further, FIG. 2 shows another example of the conventional expansion type life-saving raft which is constructed with a single annular gas chamber 100. The floor gas chamber 3 is fixedly secured to the bottom surface of this annular gas chamber 100, and the stanchion gas chamber 4 is provided on the top part of it. Moreover, the rest of the construction is the same as that shown in FIG. 1.

In the following discussion, an explanation will be given as to the manner of using the conventional expansion type life-saving raft I shown in FIG. 1. FIG. 3 is a positional diagram which represents time-sequentially positions taken by the container accommodating therein the life-saving raft I and equipment on the ship, boat, etc. from throwing-down to expansion of the life-saving raft I housed in the container. As shown in the drawing, the container 7, in which the life-saving raft I is housed, is set on a stand 9 fixed to the gunwale of a ship 8 in the state A as shown in FIG. 3. When the life-saving raft I in such condition is used at the time of maritime disaster, etc., an operating button (not shown) is manipulated by hand or by other expedient, whereupon the container 7 begins to drop in the arrow direction 110, i.e., downward to the water surface 20. At a point B, as shown in FIG. 3, to which it has fallen, the container 7 breaks a seal on the bomb 6 with an automatic cord 10 fixed at its one end on the gunwale of the ship 8, thereby actuating the bomb so as to eject gas therefrom to cause the upper and lower gas chambers 1 and 2 to expand, and, at the same time, cutting the fastening rope of the container which is formed by fitting together two semi-circular members. Following this, the raft I continues to drop while expanding. The raft I which has fallen onto the water surface 20 (the state C in FIG. 3) is further subjected to the gas filling into each of the gas chambers 1, 2, 3 and 4, and forms into a perfect raft I with the awning 5 making its top side. Accordingly, refugees are able to readily move into the life-saving raft I through the entrance 51 in the awning 5.

Incidentally, even the conventional life-saving raft I shown in FIG. 2 is also brought to a state of its use through the same steps as shown by A to C in FIG. 3.

However, the foregoing explanation about the state of its use is for a case, in which normal expansion operations were performed, and there is no guarantee that the normal expansion can always be performed, wherein the awning 5 turns upward as the condition C in FIG. 3. This is to say, at the time when the life-saving raft I is lowered and expanded, it is often observed that the expansion is performed with the awning being turned downward, as shown in FIG. 4, owing to influences such as the posture of its splash-down on the water surface 20, etc. On the other hand, even in the conventional life-saving raft I shown in FIG. 2, it is often observed that expansion is effected with the awning 5 being turned downward as shown in FIG. 5.

When the raft assumes such position as shown in FIG. 4 or 5, it is a usual practice that escapes from the ship and boat, etc. were obliged to jump into water to reverse the raft by use of rope, etc. to thereby turn the awning 5 upward. That is to say, as shown in FIG. 6, the escape 30 had to climb up that part of the raft where the bombs 6 are mounted, and to reverse the life-saving raft I by outward application of his own weight with a restituting device such as rope 31, etc. held in his hands so as to reinstate the raft to its right position with the awning thereof being turned upward. As the result of this, considerable time is required until the life-saving raft I becomes usable, which raises a serious problem at a disaster when timing can decide the fate of the refugees. In addition, for the work of reversing the life-saving raft I, the escape 30 is obliged to jump into water, as mentioned above, which disadvantageously causes him to get wet, and so forth.

SUMMARY OF THE INVENTION

The present invention serves to provide an expansion type life-saving raft which is capable of expanding itself with the awning being regularly turned upward, without failure, under whatever circumstances, and of allowing the crews to promptly evacuate at the time of disaster, such life-saving raft being realized by providing an expedient for controlling the posture of the raft at the time of its expansion so that no expansion may take place with the awning being turned downward as mentioned above, then by folding the life-saving raft with the awning being positioned inside when it is housed in the container, thereafter, by securely fixing fitting members at opposite positions on the outer peripheral part of the annular gas chamber which is placed over the other in mutual confrontation, and by applying, between the fitting members, a fastening expedient which can be ruptured or separated at least at its one part due to force of expansion of the annular gas chamber at the time of its expansion.

BRIEF DESCRIPTION OF THE DRAWING

FIG. 1 is an external view of an expansion type life-saving raft with awning, which has an upper and lower annular gas chamber, this being shown as one example of a conventional expansion type life-saving raft;

FIG. 2 is an external view of the expansion type life-saving raft with awning, which has only one annular gas chamber, this being an illustration showing another example of the conventional expansion type life-saving raft;

FIG. 6 is a view explaining a state wherein the raft is to be reversed when the awning thereof has been turned downward;

FIG. 7 is a cross-sectional view showing one embodiment of the expansion type life-saving raft according to the present invention when it is folded into two;

PREFERRED EMBODIMENT OF THE INVENTION

Figure 8:
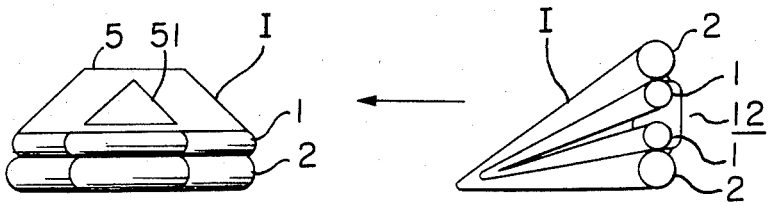
FIG. 8 is a view showing a state, wherein the life-saving raft of the embodiment shown in FIG. 7 is expanded.

In the following discussion, one embodiment of the present invention will be explained in detail in reference to the drawing. FIG. 7 is a cross-sectional view of the expansion type life-saving raft when it is folded, and FIG. 8 is a conceptual diagram for explanation of the expanded condition thereof. In the drawing, number 1 to 5 refer to the identical parts with those in FIG. 1, hence explanations thereof will be dispensed with. Number 11 refers to a fitting member or fastening device such as, for example, a fitting patch which is securely fixed at the boundary between the upper gas chamber 1 and the lower gas chamber 2, as shown in detail in FIG. 9, and, depending on necessity, is arbitrarily fitted at a plurality of points on the outer peripheral part of the gas chambers 1 and 2. Number 12 denotes a fastening device secured at least at one point on the fitting patch which is securely fixed on the outer peripheral part of the upper and lower gas chambers 1 and 2 which are folded in opposition over the other when the main body of the raft I is arbitrarily folded. This fastening device can be ruptured or separated by the force of expansion in each gas chamber. While this fastening means may be such that it fastens the mutually opposing upper and lower gas chambers in a state of the raft having been folded initially into two sections with the awning 5 placed inside as shown in FIG. 7, it may also be feasible that the fastening means be applied to opposite positions on the outer peripheral part of the upper and lower gas chambers 1 and 2 as overlaid when the raft is arbitrarily folded. Further, as another method of housing the raft, there may be contemplated a crolling method besides the folding method, although, in this case, the fastening means may also be fitted in the same manner at an arbitrary position on the outer peripheral part of it where the upper and lower chambers 1 and 2 are folded in mutual confrontation.

Figure 9:
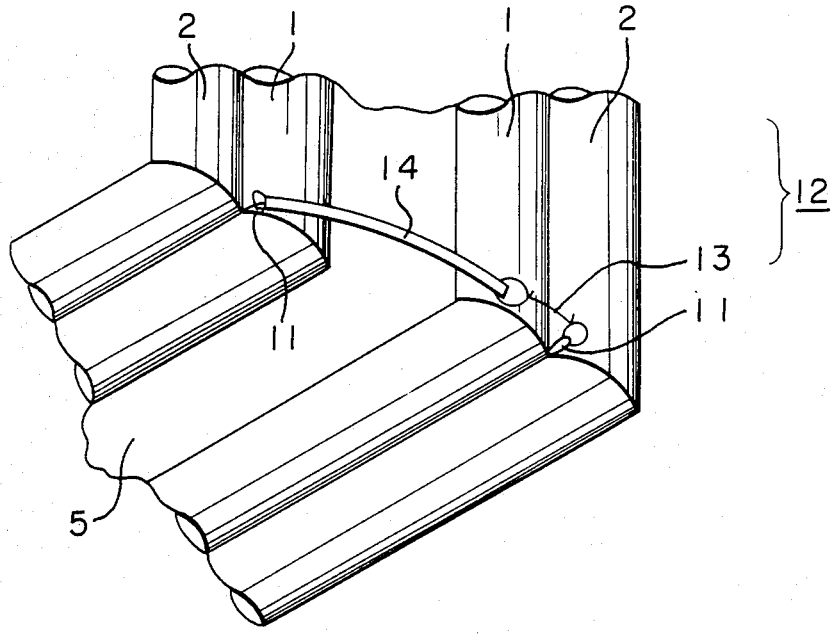
FIG. 9 is an enlarged view of a fastening expedient for the life-saving raft shown in FIGS. 7 and 8.

Incidentally, the embodiment in FIGS. 7 to 9 is shown to have both upper and lower gas chambers 1 and 2 as the annular gas chambers. However, even in the life-saving raft having the single gas chamber as shown in FIG. 2, the fitting member and the fastening means may be provided in the same manner.

Figure 4:
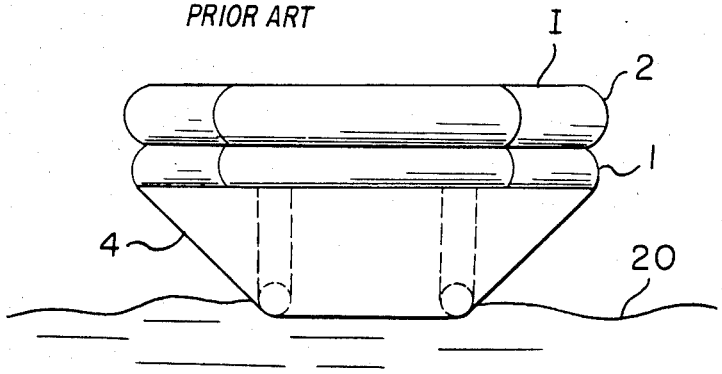
FIGURE 4 PRIOR ART
FIG. 4 and FIG. 5 are respectively diagrams showing a condition, wherein the awning of the raft which has been thrown down and expanded, is turned downward.
Figure 5:
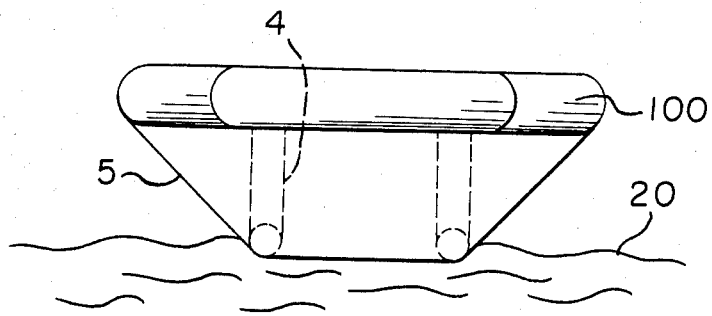
FIGURE 5 PRIOR ART

FIG. 9 shows the fastening means of FIG. 4 and FIG. 5 in its enlarged scale, which is an enlarged view illustrating a condition wherein the overlapping portion of the upper and lower gas chambers 1 and 2 has been fastened. The drawing illustrates a case wherein a disjoinable rope 13 and a fitting rope 14 are used as the fastening device 12. In this case, the fitting rope 14 having large shearing stress is fixed onto the side of one of the gas chambers, and this fitting rope 14 and the other gas chamber are fastened with the disjoinable rope 13. By effecting such fastening, the gas chamber maintains by, for example, changing the length of the fitting rope 14, its rigidly against expansion in the course of its expansion due to compressed gas such as carbon dioxide gas, etc., whereby a sustaining force can be obtained in its shape, which can be adjusted. Besides this, use of the disjoinable rope 13 facilitates the fastening, and there can be obtained various effects such as good stability and reproducibility as well as reduction in cost of the material.

Figure 10:
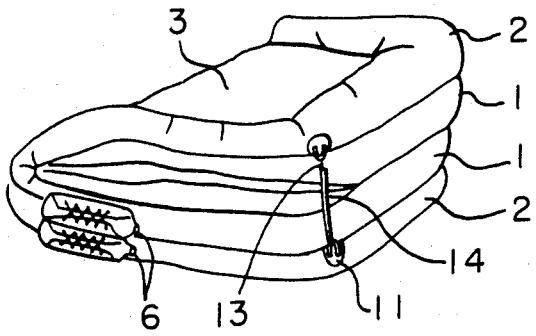
FIGS. 10 to 12 are various views for concretely explaining the state of expansion of the life-saving raft according to this embodiment.
Figure 11:
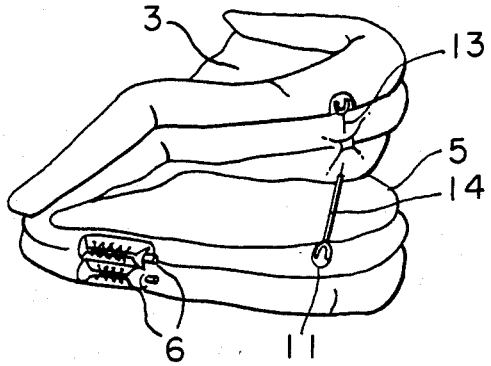

In the next place, the state of expansion of the life-saving raft I of this embodiment will be explained concretely with reference to FIG. 10 to FIG. 12. At first, the life-saving raft I is folded in two and fixedly secured by the fastening device as shown in FIG. 10. Next, the disjoinable rope 13 is severed due to expansion of the upper and lower gas chambers 1 and 2 as shown in FIG. 11.

Figure 12:
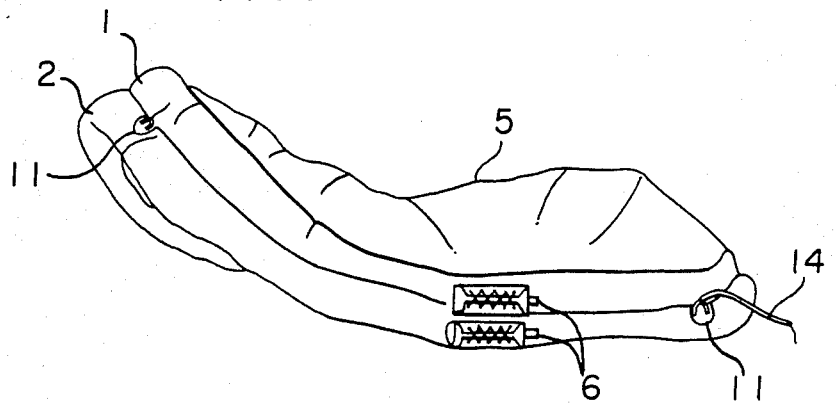

Following this, the folded portion becomes opened by the reactionary force due to tension of the fastening device and the filling of the gas into the upper and lower gas chambers 1 and 2, whereby the raft is expanded with the awning 5 being turned upward without failure as shown in FIG. 12.

Moreover, in the above explanations, an example has been given, wherein the annular gas chamber consists of upper and lower portions, although the expansion is effected in the same manner even with the life-saving raft having a single annular gas chamber.

Further, in the embodiment shown in FIG. 9, the disjoinable rope 13 is fitted on the fitting patch 11 at the side of one of the gas chambers, although this construction may be such that the disjoinable rope 13 be fitted on both sides of the fitting rope 14.

Incidentally, the fastening means may sufficiently be of such a type that, besides the above-mentioned disjoinable rope, it is breakable or separable by force of expansion of the gas chamber, for which various sorts of members such as engaging means, etc. like a fastener, hook, and so forth may be used.

Figure 13:
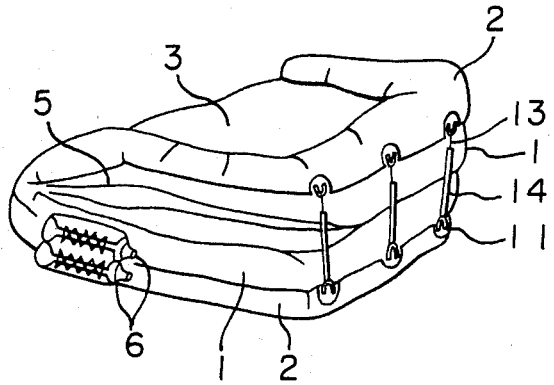
FIG. 13 is a perspective view showing another embodiment of the life-saving raft, on which a plurality of fastening members are fitted.

Furthermore, by providing the fastening means at a plurality of positions between the annular gas chambers as folded over, and fixedly securing the opposing chambers with each of the fastening means having varying strength, it is possible to obtain a construction, in which the fastening device is severed sequentially with increase in the expansion force of the raft I in the course of its expansion, which has an effect of possible adjustment in the sustaining time. That is to say, as shown in FIG. 13, the fastening device 12 is fitted at a plurality of positions and the strength of each fastening device 12 may be varied.

Figures 3A, 3B, 3C:
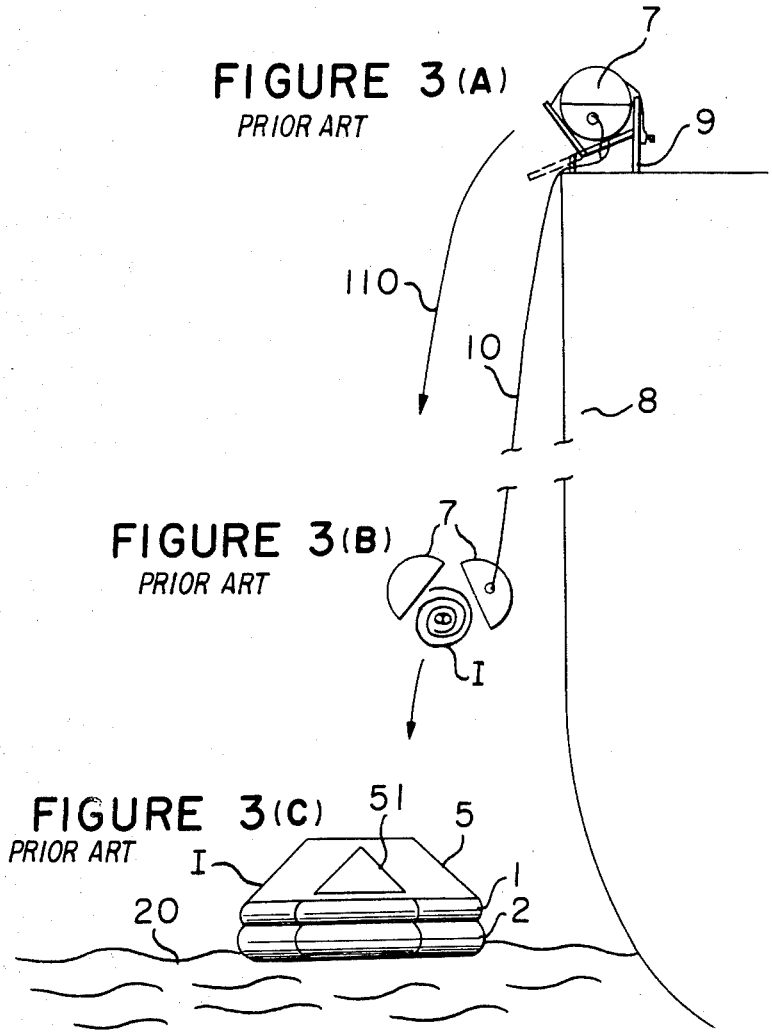
FIGURE 3(A) PRIOR ART
FIGURE 3(B) PRIOR ART
FIGURE 3(C) PRIOR ART
FIGS. 3A, B, C show a positional diagram which represents time-sequentially those positions taken by the container a aboard ship, boat, etc. when it is thrown down therefrom.

As stated in the foregoing, when the life-saving raft I of the present invention, which is folded and fastened by a fastening means and housed in a container, is dropped and expanded in the manner as shown in FIG. 3, it expands with the awning being positioned upward without failure. This is because the annular gas chamber brings about complicated and irregular movement at the time of its expansion. By thus fastening the raft with the awning being placed inside, the life-saving raft expands in such a manner that the bottom surface thereof may be always in contact with the water surface. Therefore, there is no possibility of the raft expanding with the awning being turned downward as previously experienced, so that a remarkable effect is exhibited in rescuing human life at the time of the disaster such that prompt and rapid evacuation can be done without necessity of raft reversing work being required of the refugees in the water, and other adverse requirements.

We claim:

1. A flexible, expansion type life-saving raft, comprising:

at least one annular gas chamber of ring shape;

at least one lower gas chamber fixedly secured to a bottom surface of said at least one annular gas chamber;

stanchion gas chambers provided on a top part of said annular gas chamber;

an awning which forms a roof part by being supported on said stanchion gas chambers and having an entrance formed therein, said life saving raft being folded and housed in a container when not in use, and being expanded by filling said at least one annular gas chamber, the at least one lower gas chamber and the stanchion gas chambers with gas at the time of its use, wherein at the time of housing said raft in the container, said raft is folded with said awning being placed inside;

fitting means fixedly provided at opposite positions on an outer peripheral part of said at least one annular gas chamber in a folded mutual confrontation state; and fastening means provided at least at one point between said opposite positions of said fitting means.

2. The expansion type life-saving raft as set forth in claim 1, wherein said fitting means further comprises a plurality of fitting patches adhered to said at least one annular gas chamber.

3. The expansion type life-saving raft as set forth in claim 1, wherein said fatening means further comprises a plurality of fitting ropes and disjoinable ropes.

4. The expansion type life-saving raft as set forth in claim 3, wherein said fastening means further comprises said fitting ropes being fixedly secured to a side of one of said at least one annular gas chamber folded in mutual confrontation, and said disjoinable ropes, one end of which is connected with one of said fitting ropes and the other end of which is fixedly secured to a side of a second annular gas chamber.

5. The expansion type life-saving raft as set forth in claim 4, wherein a total length of each of said fitting ropes and said disjoinable ropes at the time of fastening is adjusted when said annular gas chamber is folded so as to be substantially equal to a distance defined between the fitting members when the at least one annular gas chamber is substantially gas-filled.

6. The expansion type life-saving raft as set forth in claim 3, further comprising a plurality of sets of said fitting ropes, said disjoinable ropes and wherein said sets are fitted at a plurality of positions on said at least one annular gas chamber folded in mutual confrontation.

7. The expansion type life-saving raft as set forth in claim 6, wherein said sets are positioned such that said disjoinable ropes are capable of being sequentially ruptured upon expansion of the annular gas chamber.

8. The expansion type life-saving raft as set forth in claim 1, wherein said fastening means further comprises an engaging device.

9. The expansion type life-saving raft as set forth in claim 8, wherein said engaging device further comprises a planar fastener.

10. The expansion type life-saving raft as set forth in claim 8, wherein said engaging device further comprises a hook.

11. The expansion type life-saving raft as set forth in claim 1, wherein said at least one annular gas chamber further comprises a structure having at least an upper gas chamber and a lower gas chamber, wherein a floor gas chamber is fixedly secured to a bottom surface of the lower gas chamber.

* * * * *